US011371524B2

(12) United States Patent
Lin et al.

(10) Patent No.: US 11,371,524 B2
(45) Date of Patent: Jun. 28, 2022

(54) WINDMILL AND BLOWER COMPRISING THE SAME

(71) Applicant: Zhongshan Broad-Ocean Motor Co., Ltd., Zhongshan (CN)

(72) Inventors: Yanhu Lin, Zhongshan (CN); Miao Zhang, Zhongshan (CN); Wei Lei, Zhongshan (CN)

(73) Assignee: ZHONGSHAN BROAD-OCEAN MOTOR CO., LTD., Zhongshan (CN)

( * ) Notice: Subject to any disclaimer, the term of this patent is extended or adjusted under 35 U.S.C. 154(b) by 0 days.

(21) Appl. No.: 16/903,353

(22) Filed: Jun. 16, 2020

(65) Prior Publication Data

US 2020/0309148 A1 Oct. 1, 2020

Related U.S. Application Data

(63) Continuation-in-part of application No. PCT/CN2018/104247, filed on Sep. 5, 2018.

(30) Foreign Application Priority Data

Mar. 20, 2018 (CN) ..... 201820379907.7
Apr. 4, 2018 (CN) ..... 201810299985.0

(51) Int. Cl.
*F04D 29/28* (2006.01)
*F04D 25/08* (2006.01)
(Continued)

(52) U.S. Cl.
CPC ..... *F04D 29/281* (2013.01); *F04D 25/08* (2013.01); *F04D 29/30* (2013.01); *F04D 29/34* (2013.01);
(Continued)

(58) Field of Classification Search
CPC ..... F04D 29/281; F04D 29/30; F04D 29/34; F04D 29/388; F05D 2260/30
See application file for complete search history.

(56) References Cited

U.S. PATENT DOCUMENTS 2,471,174 A * 5/1949 Trumpler ..... F04D 29/30 415/58.6
6,146,094 A * 11/2000 Obana ..... F04D 29/023 415/200
(Continued)

FOREIGN PATENT DOCUMENTS

CN 201003508 Y 1/2008
CN 201779061 U 3/2011
(Continued)

*Primary Examiner* — Ninh H. Nguyen
(74) *Attorney, Agent, or Firm* — Matthias Scholl P.C.; Matthias Scholl

(57) ABSTRACT

A windmill, including a first end plate, a second end plate, and a plurality of primary blades disposed between the first end plate and the second end plate. The first end plate includes a central part provided with a base connected to a motor shaft. The second end plate includes a central part provided with an air inlet; the space between every two adjacent blades forms an air channel. The plurality of primary blades each includes an outmost end with respect to the central part of the first end plate, and the outmost end extends out of an outer edge of the second end plate. The connection line of every two adjacent outmost ends of the plurality of primary blades forms a circle, and the diameter D1 of the circle is larger than the diameter D2 of the second end plate.

19 Claims, 20 Drawing Sheets

(51) Int. Cl.

| | |
|---|---|
| ***F04D 29/30*** | (2006.01) |
| ***F04D 29/62*** | (2006.01) |
| ***F04D 29/38*** | (2006.01) |
| ***F04D 29/34*** | (2006.01) |

(52) U.S. Cl.
CPC ..... *F04D 29/388* (2013.01); *F04D 29/62* (2013.01); *F05D 2250/71* (2013.01); *F05D 2260/30* (2013.01)

(56) References Cited

U.S. PATENT DOCUMENTS

| | | | | |
|---|---|---|---|---|
| 6,805,531 | B2 * | 10/2004 | Iida | B29C 45/0062 415/206 |
| 7,165,938 | B2 * | 1/2007 | Lee | F04D 29/424 415/206 |
| 7,278,823 | B2 * | 10/2007 | Platz | F04D 29/4233 415/204 |
| 8,882,467 | B2 * | 11/2014 | Kwok | F04D 29/281 416/186 R |
| 2018/0238337 | A1 * | 8/2018 | Kneip | H02K 1/28 |

FOREIGN PATENT DOCUMENTS

| | | | |
|---|---|---|---|
| CN | 202690528 | U | 1/2013 |
| CN | 104929977 | A | 9/2015 |
| CN | 204783827 | U | 11/2015 |
| CN | 108223443 | A | 6/2018 |
| DE | 202017103925 | U1 | 8/2017 |
| JP | 2000145690 | A | 5/2000 |

* cited by examiner

WINDMILL AND BLOWER COMPRISING THE SAME

CROSS-REFERENCE TO RELATED APPLICATIONS

This application is a continuation-in-part of International Patent Application No. PCT/CN2018/104247 with an international filing date of Sep. 5, 2018, designating the United States, now pending, and further claims foreign priority benefits to Chinese Patent Application No. 201810299985.0 filed Apr. 4, 2018, and to Chinese Patent Application No. 201820379907.7 filed Mar. 20, 2018. The contents of all of the aforementioned applications, including any intervening amendments thereto, are incorporated herein by reference. Inquiries from the public to applicants or assignees concerning this document or the related applications should be directed to: Matthias Scholl P C., Attn.: Dr. Matthias Scholl Esq., 245 First Street, 18th Floor, Cambridge, Mass. 02142.

BACKGROUND

The disclosure relates to a windmill and a blower comprising the same.

As shown in FIGS. 1 and 2, a conventional windwheel includes a first end plate A1, a second end plate A2, and a plurality of blades A3 disposed between the first end plate A1 and the second end plate A2. The second end plate A2 includes a central part provided with an air inlet. The space between every two adjacent blades forms an air channel A4. The air outlet of the air channel A4 is disposed on the outer edge of the second end plate with respect to the central part. The diameters of the first end plate A1, the second end plate A2, and the plurality of blades A3 are identical.

SUMMARY

The disclosure provides a windmill, comprising a first end plate, a second end plate, and a plurality of primary blades disposed between the first end plate and the second end plate.

The first end plate comprises a central part provided with a base connected to a motor shaft; the second end plate comprises a central part provided with an air inlet; the space between every two adjacent blades forms an air channel; the plurality of primary blades each comprises an outmost end with respect to the central part of the first end plate, and the outmost end extends out of an outer edge of the second end plate; and the connection line of every two adjacent outmost ends of the plurality of primary blades forms a circle, and a diameter D1 of the circle is larger than a diameter D2 of the second end plate.

The first end plate comprises an outer edge with respect to the central part; the outer edge comprises a plurality of secondary blades; and the plurality of secondary blades and the plurality of primary blades are disposed on two opposite surfaces of the first end plate, respectively.

The diameter D1 of the circle is equal to a diameter of the first end plate.

The ratio of the diameter D2 of the second end plate to the diameter D1 of the circle is between 0.85 and 0.95. Particularly, D2=0.9 D1.

The plurality of primary blades each comprises an end face abutting against the second end plate; the end face comprises a plurality of locating pins; the second end plate comprises a plurality of mounting holes; and the plurality of locating pins is disposed in or bonded to the plurality of mounting holes, respectively.

The plurality of primary blades is integrated with the first end plate through injection molding; the end face further comprises a plurality of lug bosses; the second end plate further comprises a plurality of grooves; and the plurality of lug bosses is disposed in or bonded to the plurality of grooves, respectively.

The first end plate comprises a surface; the surface comprises an outer edge with respect to the central part; the outer edge comprises a plurality of secondary blades protruding from the surface; the plurality of secondary blades and the plurality of primary blades are disposed on two opposite surfaces of the first end plate, respectively; and both the plurality of secondary blades and the plurality of primary blades are integrated with the first end plate through injection molding.

The second end plate further comprises a plurality of bulges disposed in each of the plurality of grooves; when the plurality of lug bosses is disposed in the plurality of grooves, the plurality of lug bosses abuts against the plurality of bulges, respectively.

The plurality of bulges is equidistantly disposed in each of the plurality of grooves.

The plurality of lug bosses is disposed on two ends of the end face, respectively; and a recess is disposed between every two adjacent lug bosses.

The plurality of locating pins on the end face of the plurality of primary blades is disposed in the recess.

Two locating pins are disposed on two ends of the recess, respectively.

The disclosure also provides a blower, comprising a volute, a cover plate, a motor, a motor shaft and the windwheel. The volute is connected to the cover plate whereby forming a cavity; the windwheel is disposed in the cavity; the volute comprises an air outlet, and the cover plate comprises an air intake.

Compared with conventional windwheels, advantages of the windwheel according to embodiments of the disclosure are summarized as follows:

1) Compared with conventional windwheels, the sectional area of the air outlet of the windwheel of the disclosure is increased, thereby reducing the vibration and noise of the machine.

2) The first end plate comprises an outer edge with respect to the central part; the outer edge comprises a plurality of secondary blades. The plurality of secondary blades and the plurality of primary blades are disposed on two opposite surfaces of the first end plate, respectively. This can increase the negative pressure to the windwheel, thus reducing the noise.

3) The relationship of the diameter D2 of the second end plate 2 and the diameter D1 of the circle is D2=0.9 D1. The design can improve the efficiency of the machine, and output larger static pressure and higher air volume without increasing the rotation speed.

4) The end face of the plurality of primary blades comprises a plurality of lug bosses; the second end plate further comprises a plurality of grooves; and the plurality of lug bosses is welded to the plurality of grooves, respectively. The design simplifies the welding operation, reduces the probability of missing welding, improves the welding accuracy, and the welding is firm, thereby solving the problems of bounce and imbalance of the windwheel during operation.

DETAILED DESCRIPTION

Figure 1:
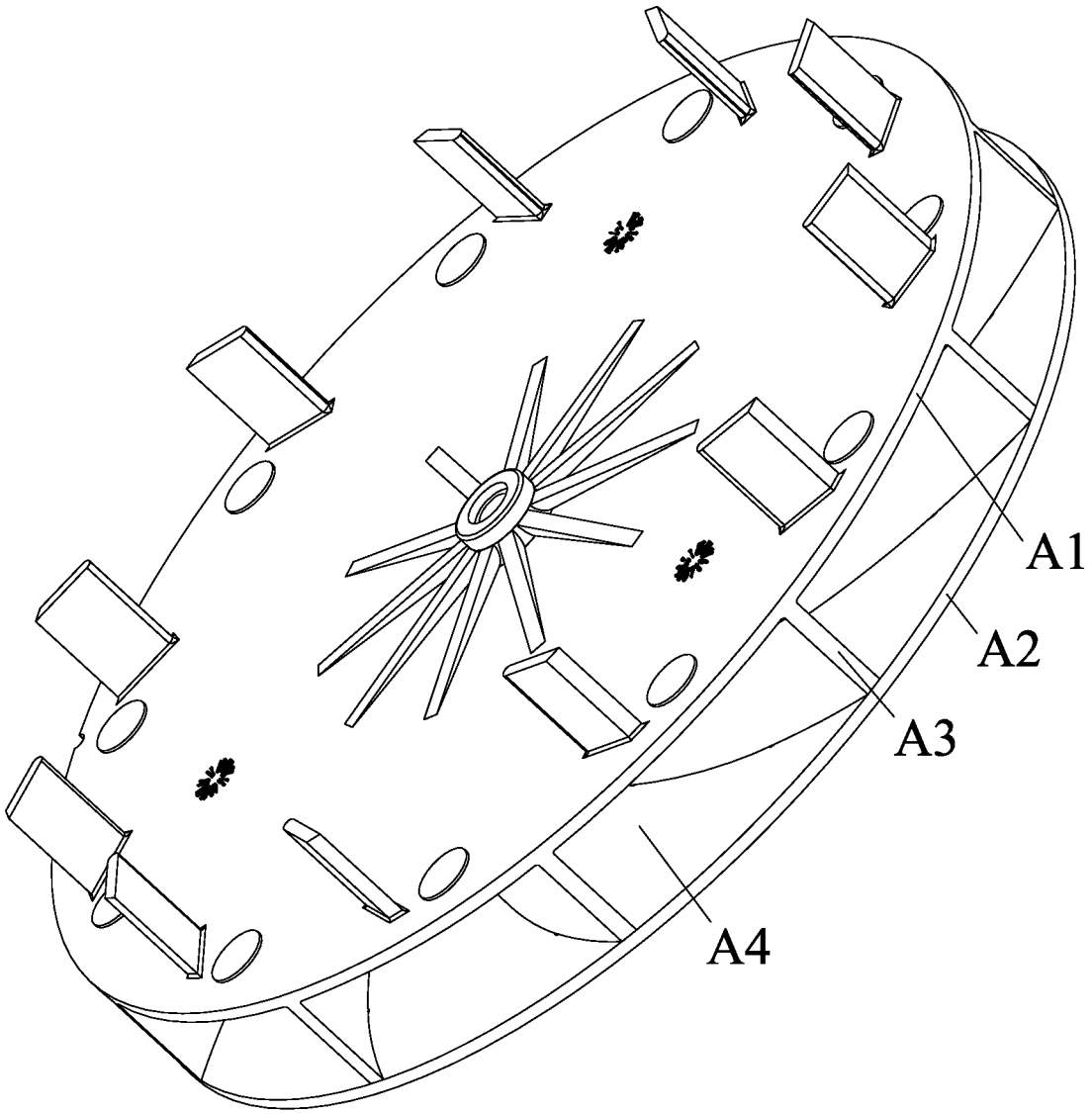
FIG. 1 (Prior art)
FIG. 1 is a schematic diagram of a windmill in the prior art.
Figure 2:
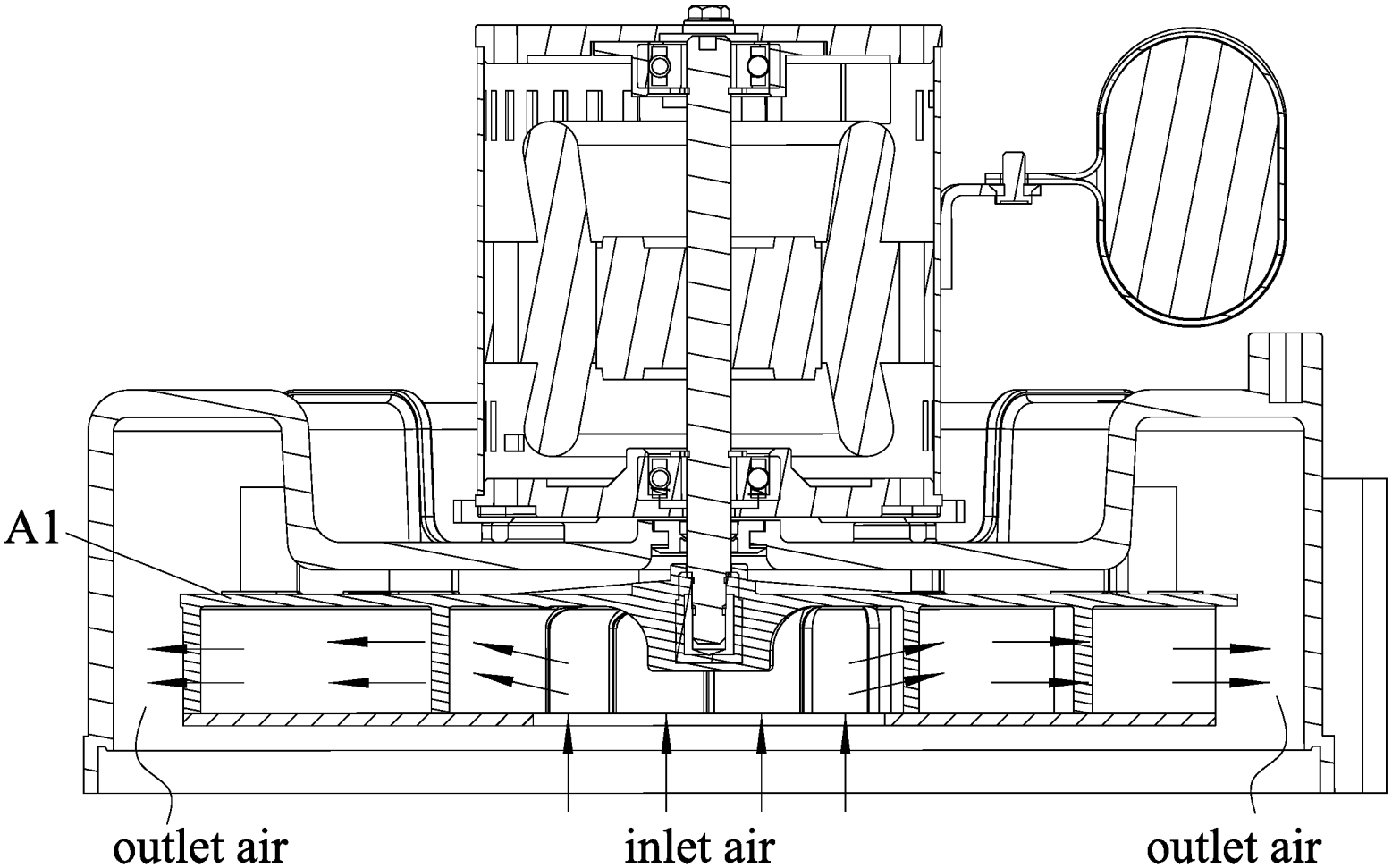
FIG. 2 (Prior art)
FIG. 2 shows an air flow direction of a windmill in the prior art.
Figure 3:
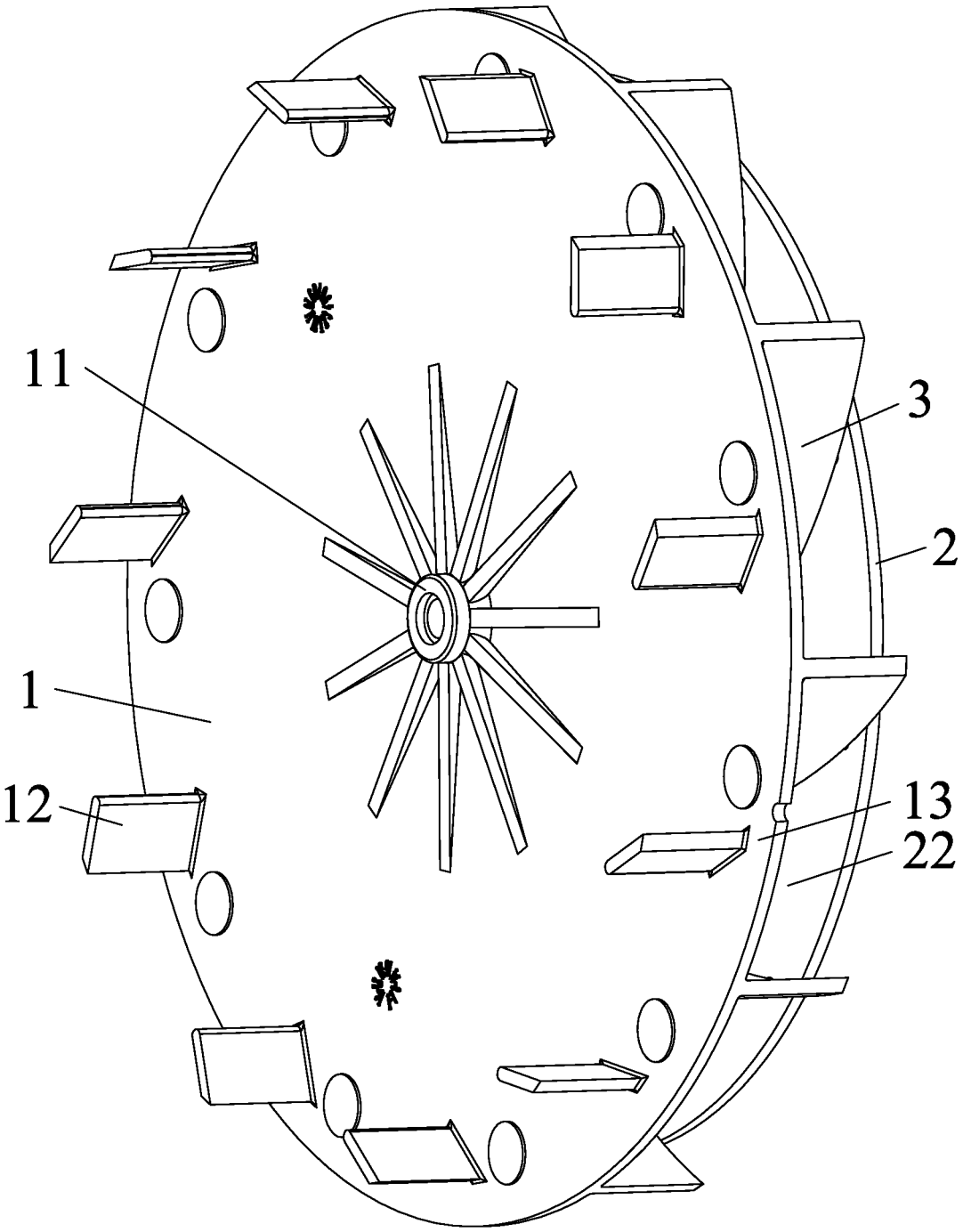
FIG. 3 is a schematic diagram of a windmill according to one embodiment of the disclosure.
Figure 4:
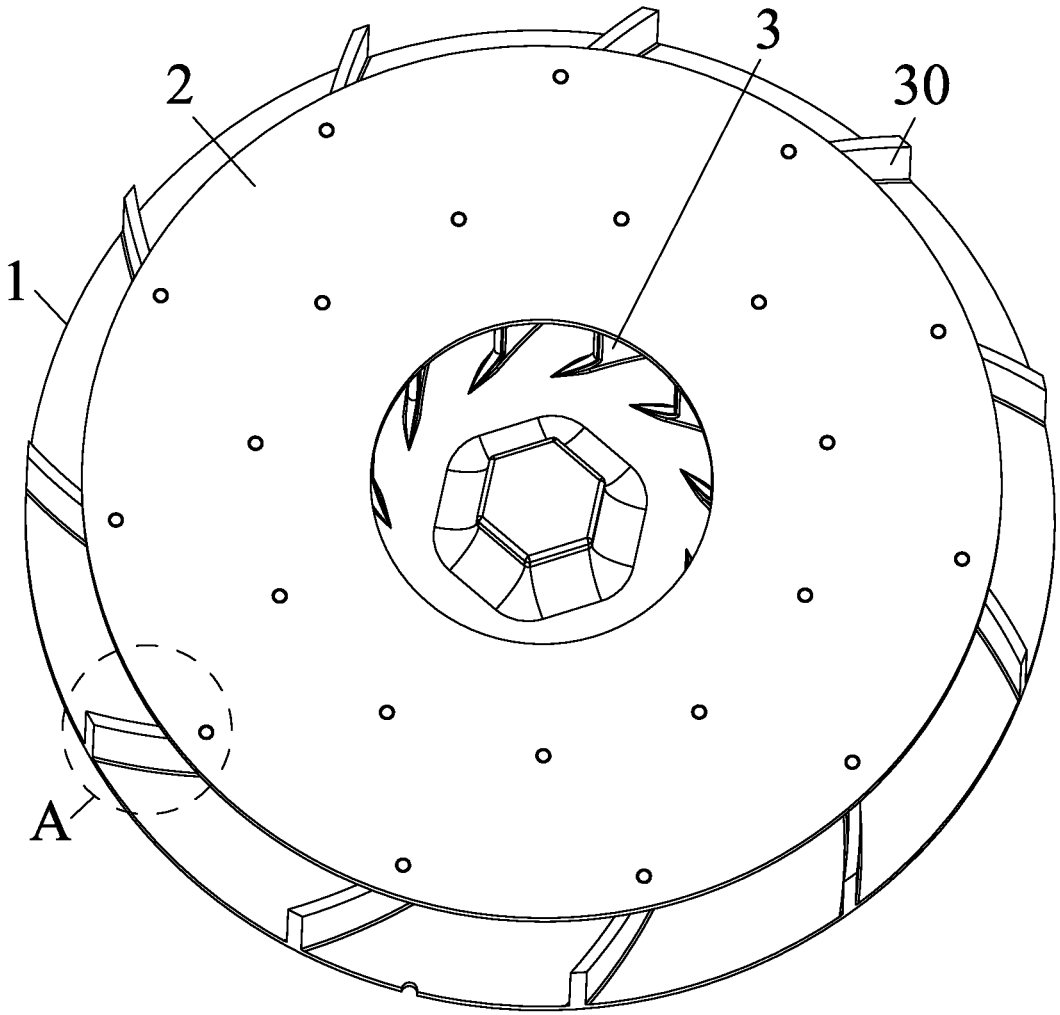
FIG. 4 is another schematic diagram of a windmill according to one embodiment of the disclosure.
Figure 5:
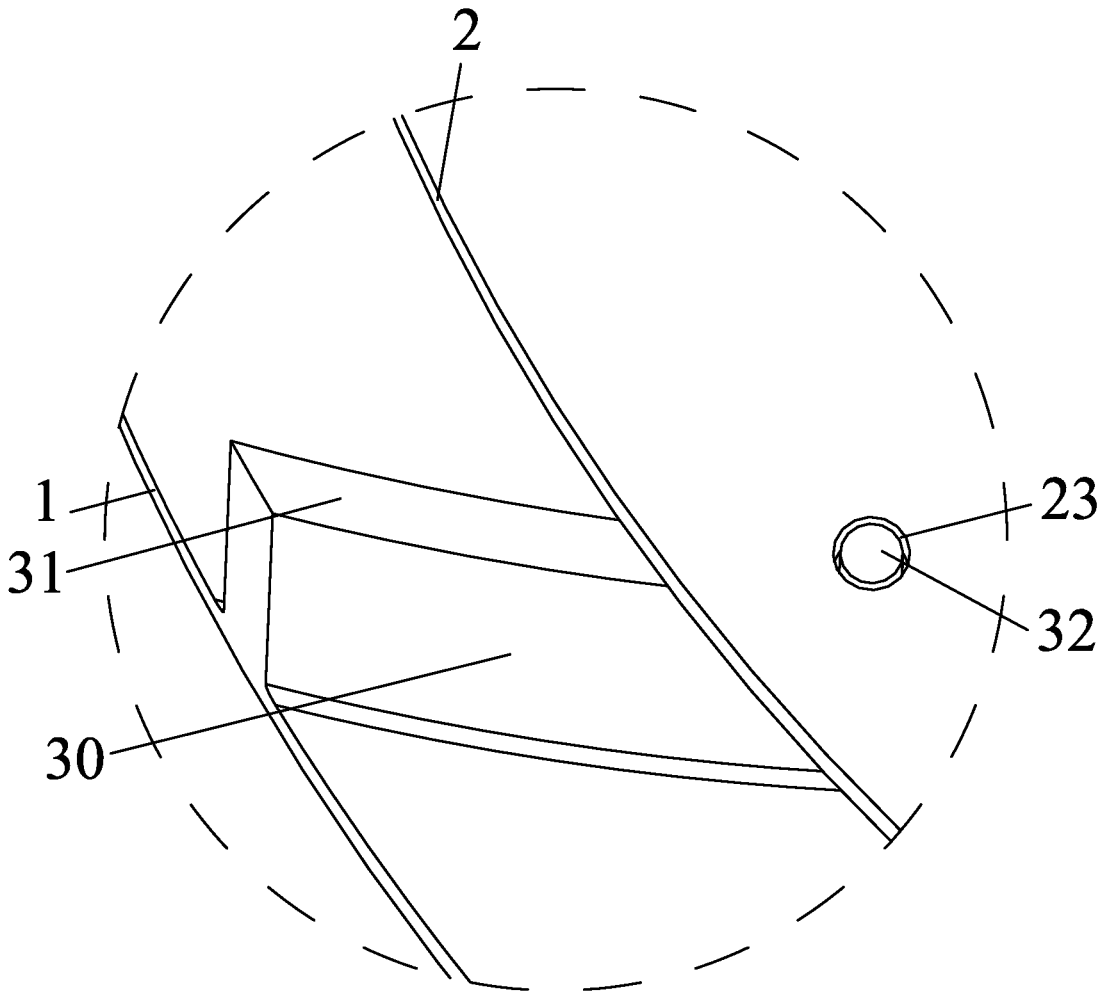
FIG. 5 is a local enlarged view of part A in FIG. 4.
Figure 6:
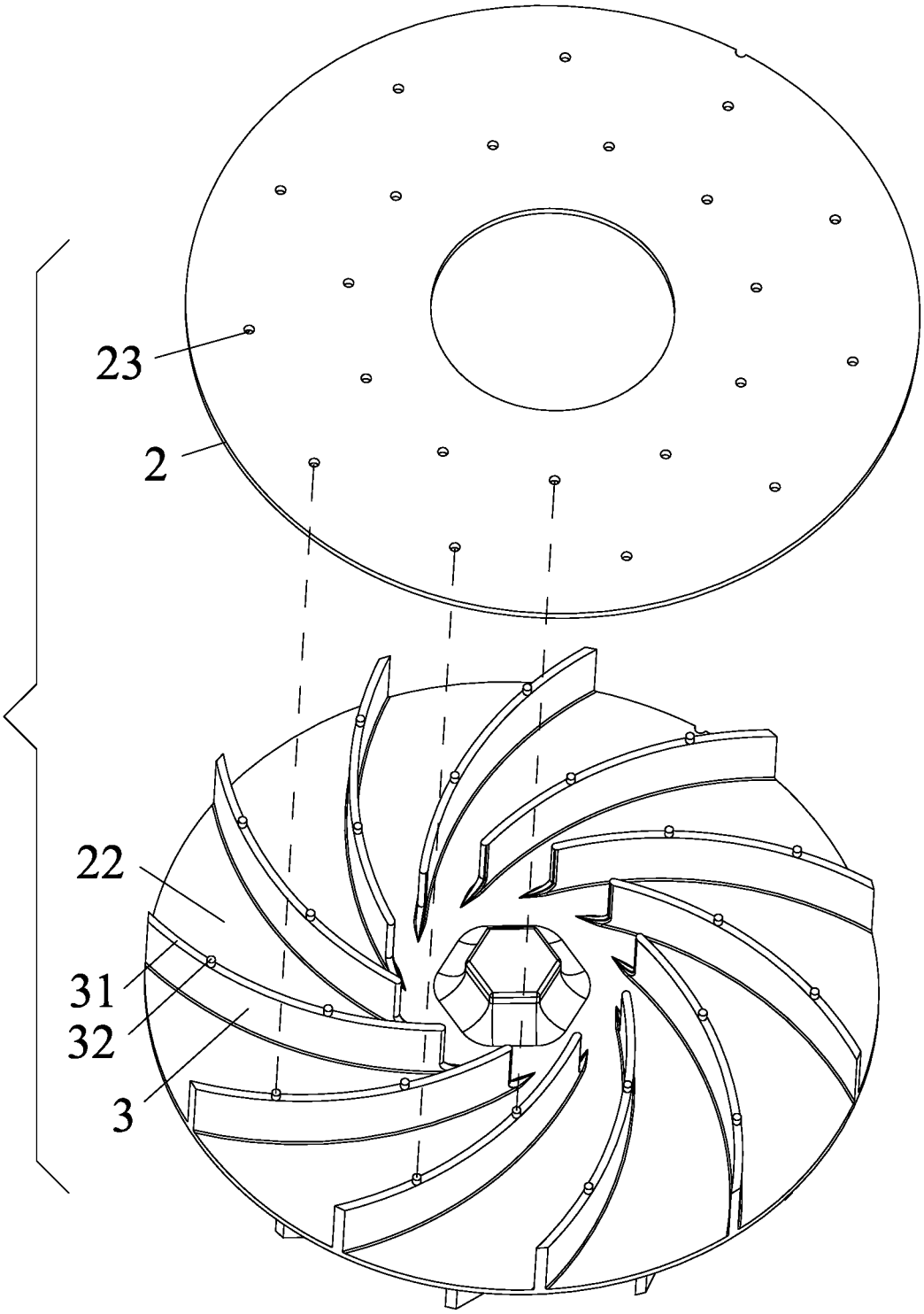
FIG. 6 is an exploded view of a windmill according to one embodiment of the disclosure.
Figure 7:
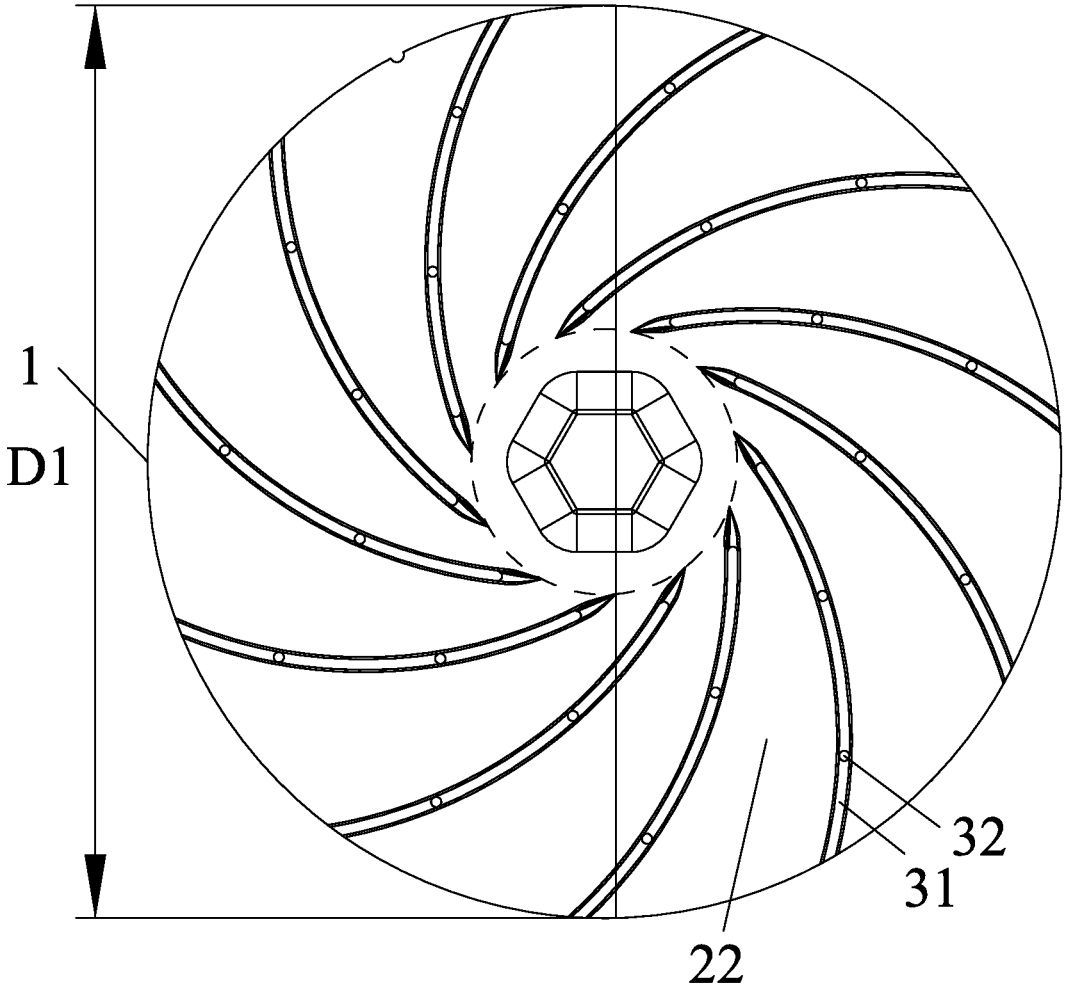
FIG. 7 shows a diameter of a first end plate of a windmill according to one embodiment of the disclosure.

To further illustrate the disclosure, embodiments detailing a windmill and a blower comprising the same are described below. It should be noted that the following embodiments are intended to describe and not to limit the disclosure.

Example 1

As shown in FIGS. 3-9, a windwheel comprises a first end plate 1, a second end plate 2, and a plurality of primary blades 3 disposed between the first end plate 1 and the second end plate 2. The first end plate 1 comprises a central part provided with a base 11 connected to a motor shaft; the second end plate 2 comprises a central part provided with an air inlet 21; the space between every two adjacent blades forms an air channel 22; the plurality of primary blades 3 each comprises an outmost end 30 with respect to the central part of the first end plate 1, and the outmost end 30 extends out of an outer edge of the second end plate 2; and the connection line of every two adjacent outmost ends of the plurality of primary blades 3 forms a circle, and the diameter D1 of the circle is larger than the diameter D2 of the second end plate 2.

The first end plate 1 comprises an outer edge 13 with respect to the central part; the outer edge 13 comprises a plurality of secondary blades 12; and the plurality of secondary blades 12 and the plurality of primary blades 3 are disposed on two opposite surfaces of the first end plate 1, respectively.

The diameter D1 of the circle is equal to a diameter of the first end plate 1.

The ratio of the diameter D2 of the second end plate 2 to the diameter D1 of the circle is between 0.85 and 0.95.

The relationship of the diameter D2 of the second end plate 2 and the diameter D1 of the circle is D2=0.9 D1.

The plurality of primary blades 3 each comprises an end face 31 abutting against the second end plate 2; the end face 31 comprises a plurality of locating pins 32; the second end plate 2 comprises a plurality of mounting holes 23; and the plurality of locating pins 32 is disposed in or bonded to the plurality of mounting holes 23, respectively.

Figure 8:
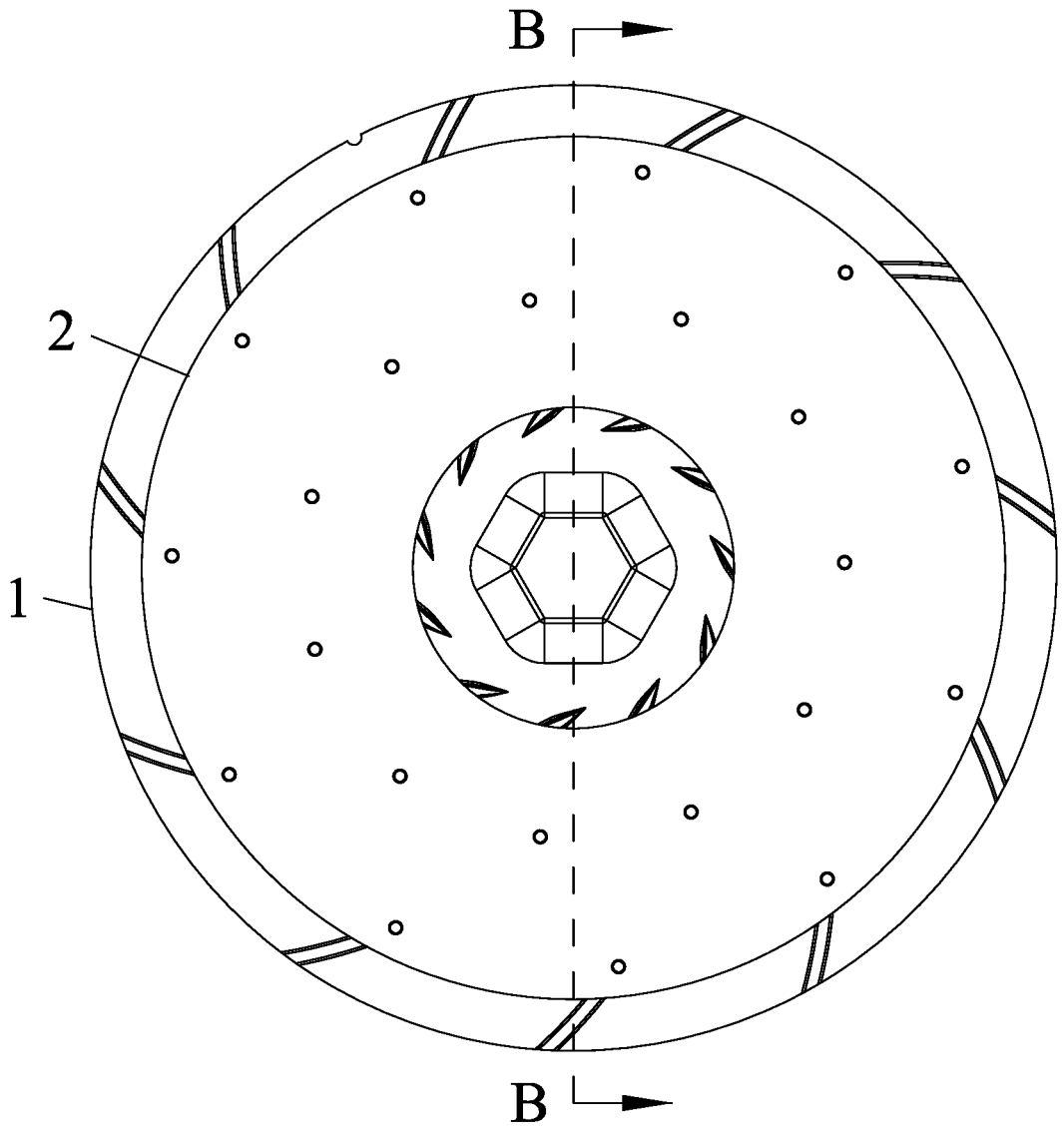
FIG. 8 is a front view of a windmill according to one embodiment of the disclosure.
Figure 9:
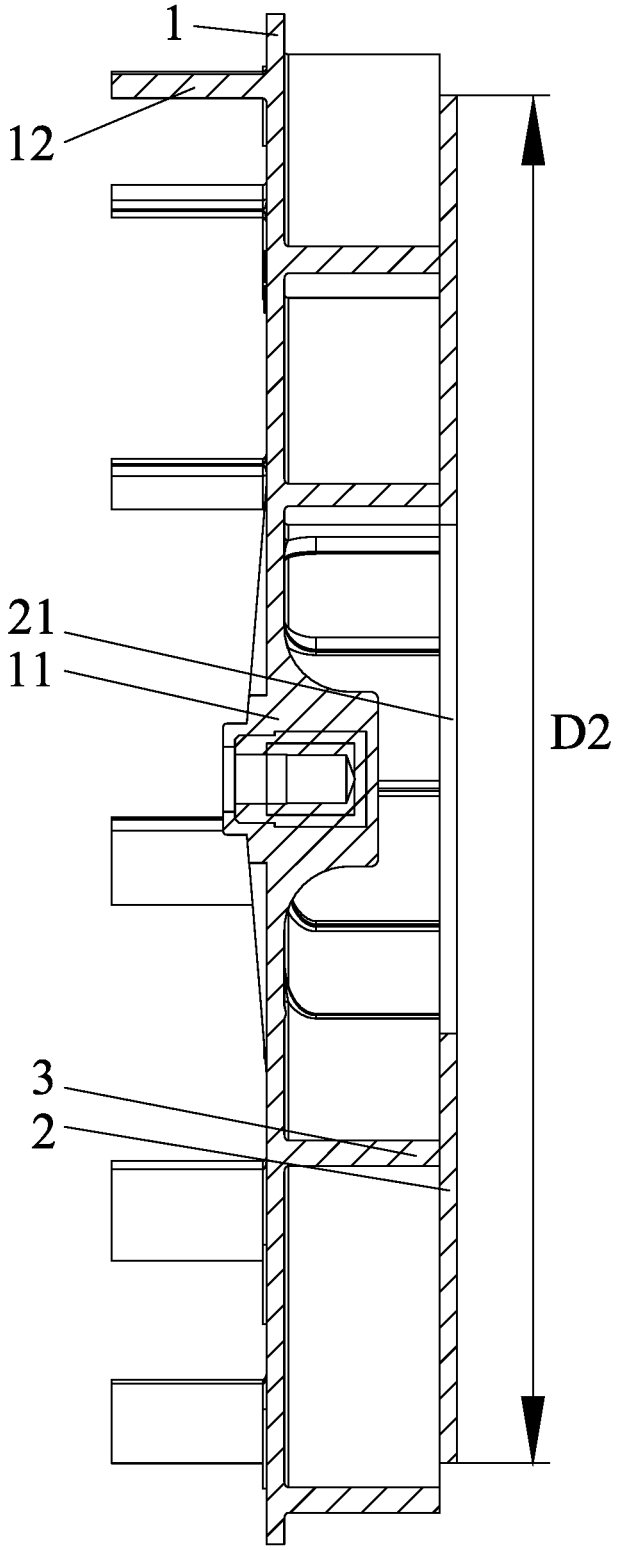
FIG. 9 is a section view taken from line B-B in FIG. 8.
Figure 10:
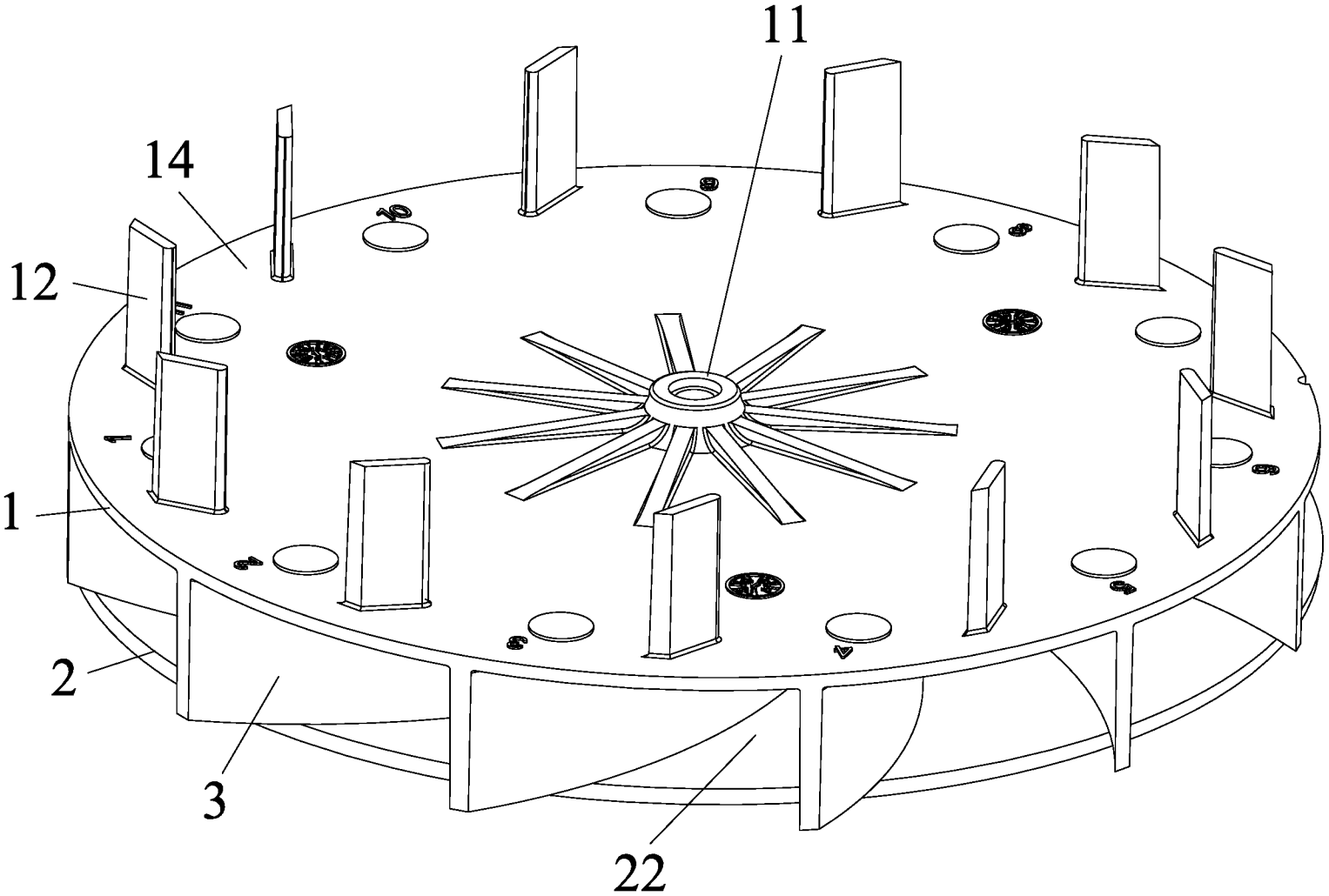
FIG. 10 is a schematic diagram of a windmill according to another embodiment of the disclosure.
Figure 11:
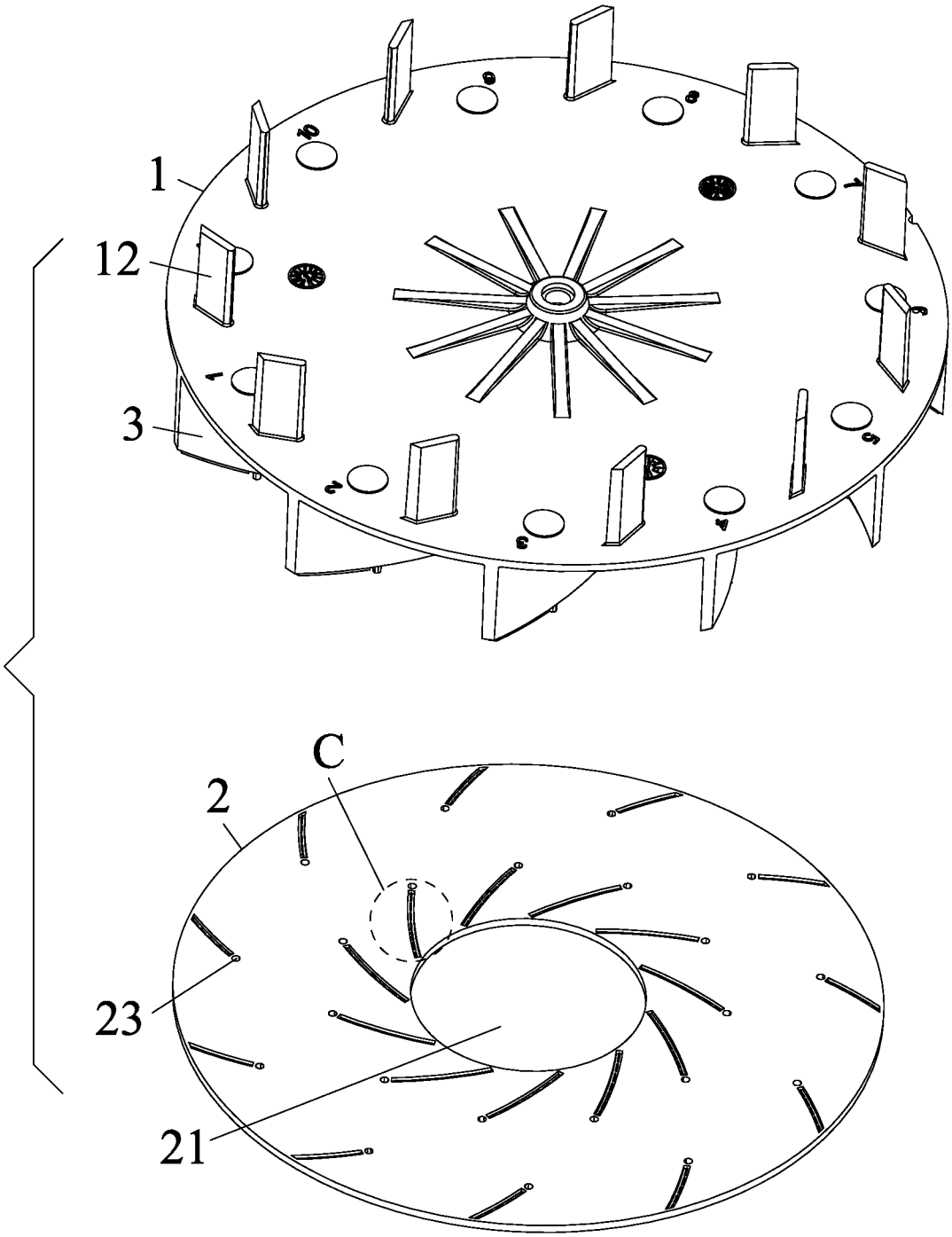
FIG. 11 is a first exploded view of a windmill according to another embodiment of the disclosure.
Figure 12:
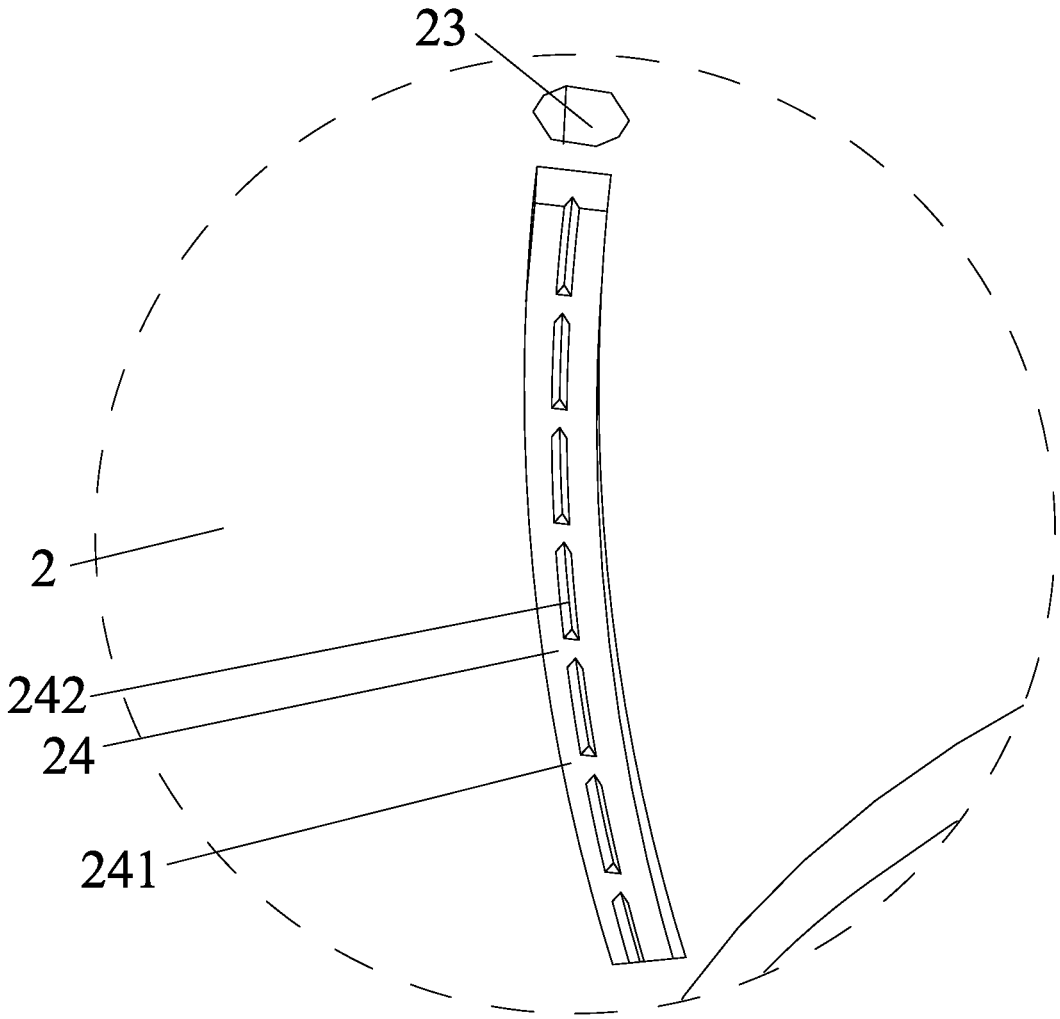
FIG. 12 is a local enlarged view of part C in FIG. 11.
Figure 13:
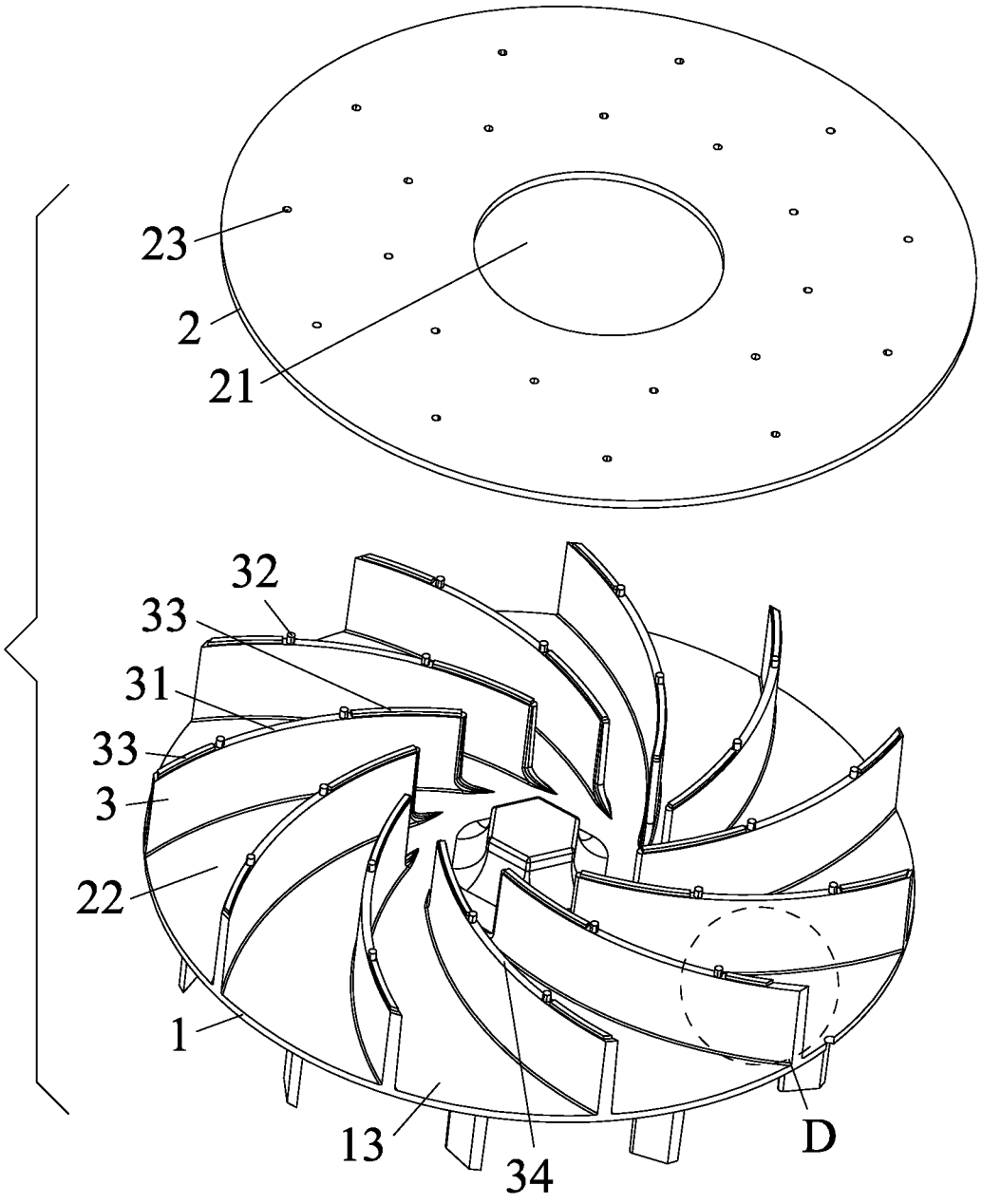
FIG. 13 is a second exploded view of a windmill according to another embodiment of the disclosure.
Figure 14:
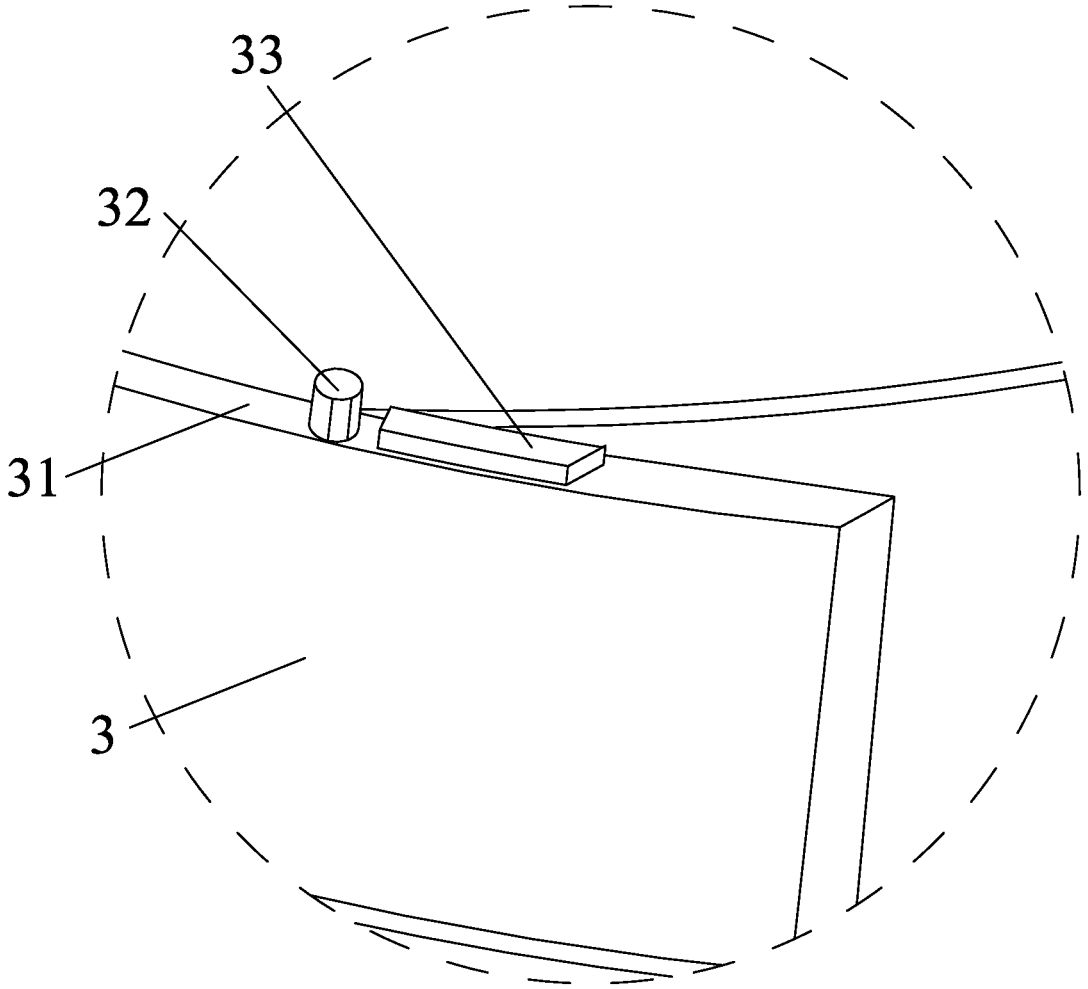
FIG. 14 is a local enlarged view of part D in FIG. 13.
Figure 15:
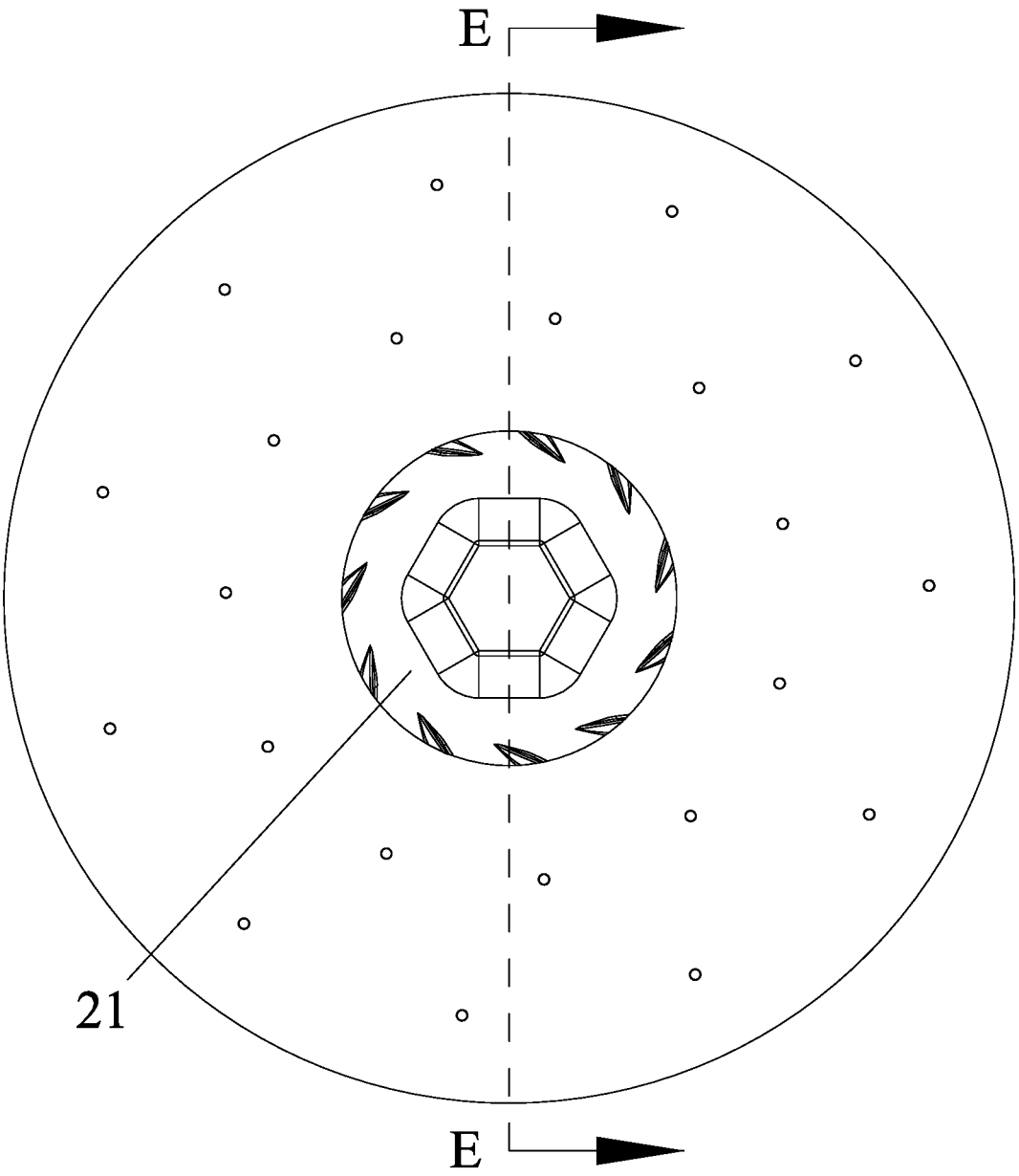
FIG. 15 is a front view of a windmill according to another embodiment of the disclosure.
Figure 16:
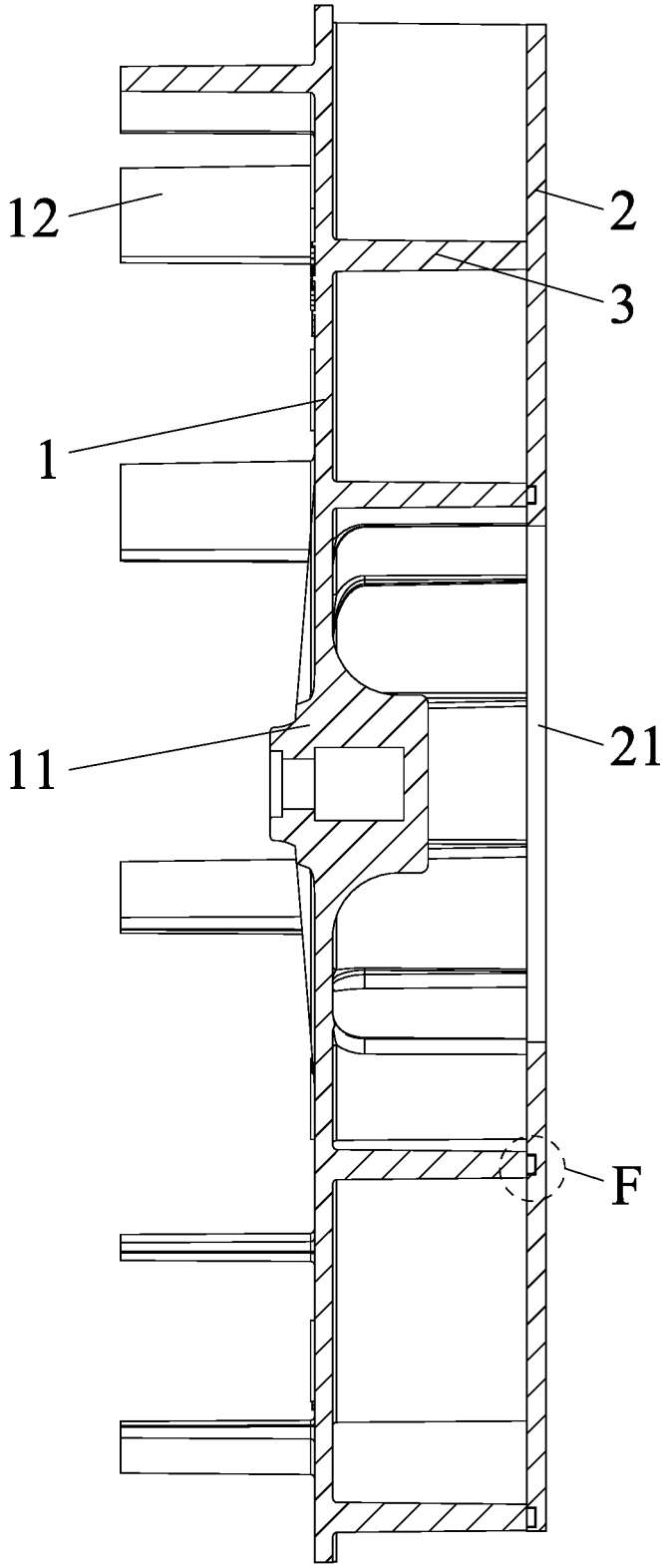
FIG. 16 is a section view taken from line E-E in FIG. 15.
Figure 17:
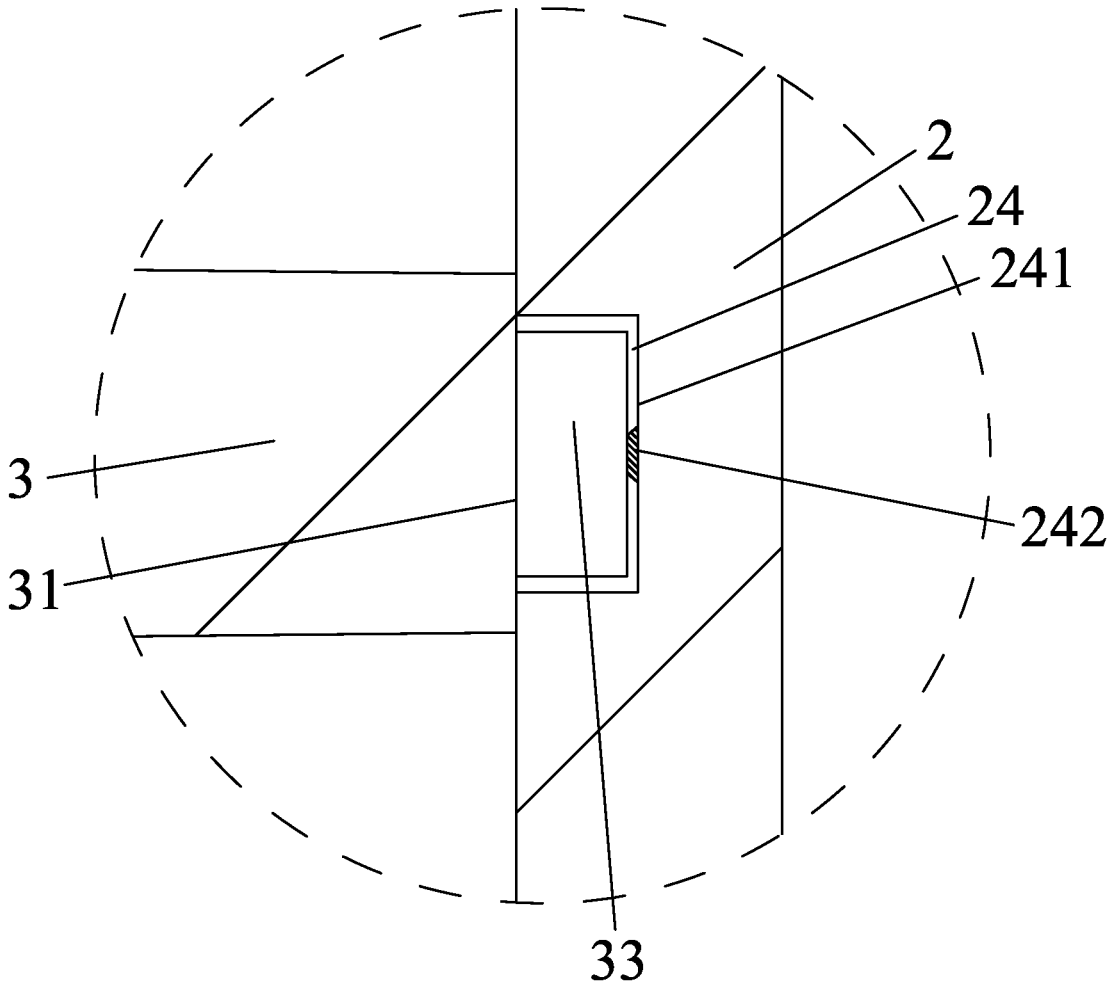
FIG. 17 is a local enlarged view of part F in FIG. 16.

As shown in FIG. 8, compared with conventional windwheels, the sectional area of the air outlet of the windwheel of the disclosure is increased, thereby reducing the vibration and noise of the machine.

Example 2

The windwheel of the example is an improved one based on that in Example 1. As shown in FIGS. 10-17, the plurality of primary blades 3 each comprises an end face 31 abutting against the second end plate 2; the end face 31 comprises a plurality of locating pins 32; the second end plate 2 comprises a plurality of mounting holes 23; and the plurality of locating pins 32 is welded or bonded to the plurality of mounting holes 23, respectively.

The plurality of primary blades 3 is integrated with the first end plate 1 through injection molding; the end face 31 further comprises a plurality of lug bosses 33; the second end plate 2 further comprises a plurality of grooves 24; and the plurality of lug bosses 33 is welded to the plurality of grooves 24, respectively. The design simplifies the welding operation, reduces the probability of missing welding, improves the welding accuracy, and the welding is firm, thereby solving the problems of bounce and imbalance of the windwheel during operation.

The first end plate 1 comprises a surface 14; the surface 14 comprises an outer edge with respect to the central part; the outer edge 13 comprises a plurality of secondary blades 12 protruding from the surface; the plurality of secondary blades 12 and the plurality of primary blades 3 are disposed on two opposite surfaces of the first end plate 1, respectively; and both the plurality of secondary blades 12 and the plurality of primary blades 3 are integrated with the first end plate 1 through injection molding.

The second end plate 2 further comprises a plurality of bulges 242 disposed on a bottom surface 241 of each of the plurality of grooves 24; when the plurality of lug bosses 33 is disposed in the plurality of grooves 24, the front ends of the plurality of lug bosses 33 are directly welded to the front ends of the plurality of bulges 242.

The plurality of bulges 242 is equidistantly disposed on the bottom surface 241 of each of the plurality of grooves 24.

The plurality of lug bosses 33 are disposed on two ends of the end face 31, respectively; and a recess 34 is disposed between every two adjacent lug bosses 33.

The plurality of locating pins 32 on the end face 31 of the plurality of primary blades 3 is disposed in the recess 34.

Two locating pins 32 are disposed on two ends of the recess 34, respectively.

Example 3

Figure 18:
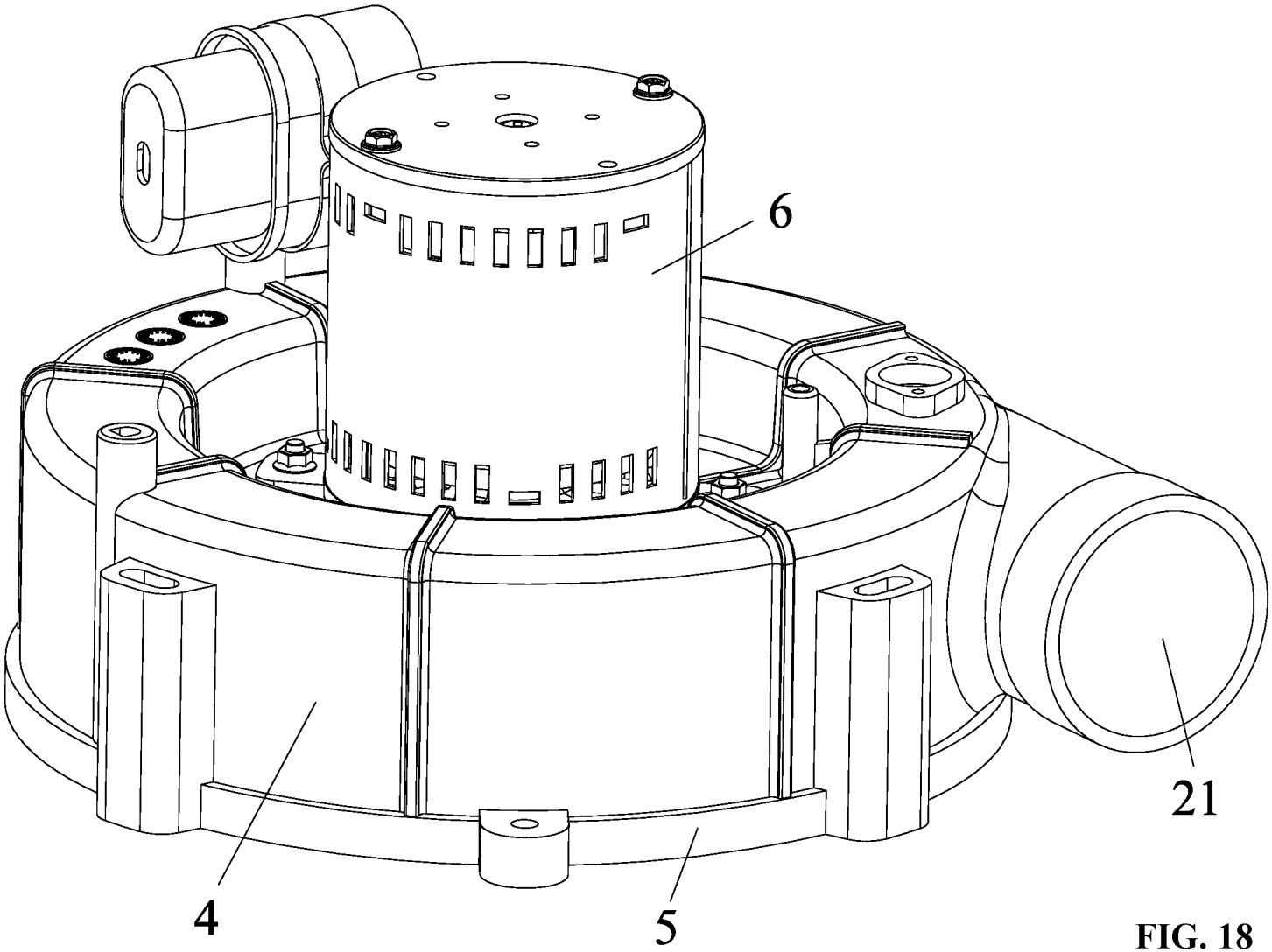
FIG. 18 is a schematic diagram of a blower according to one embodiment of the disclosure.
Figure 19:
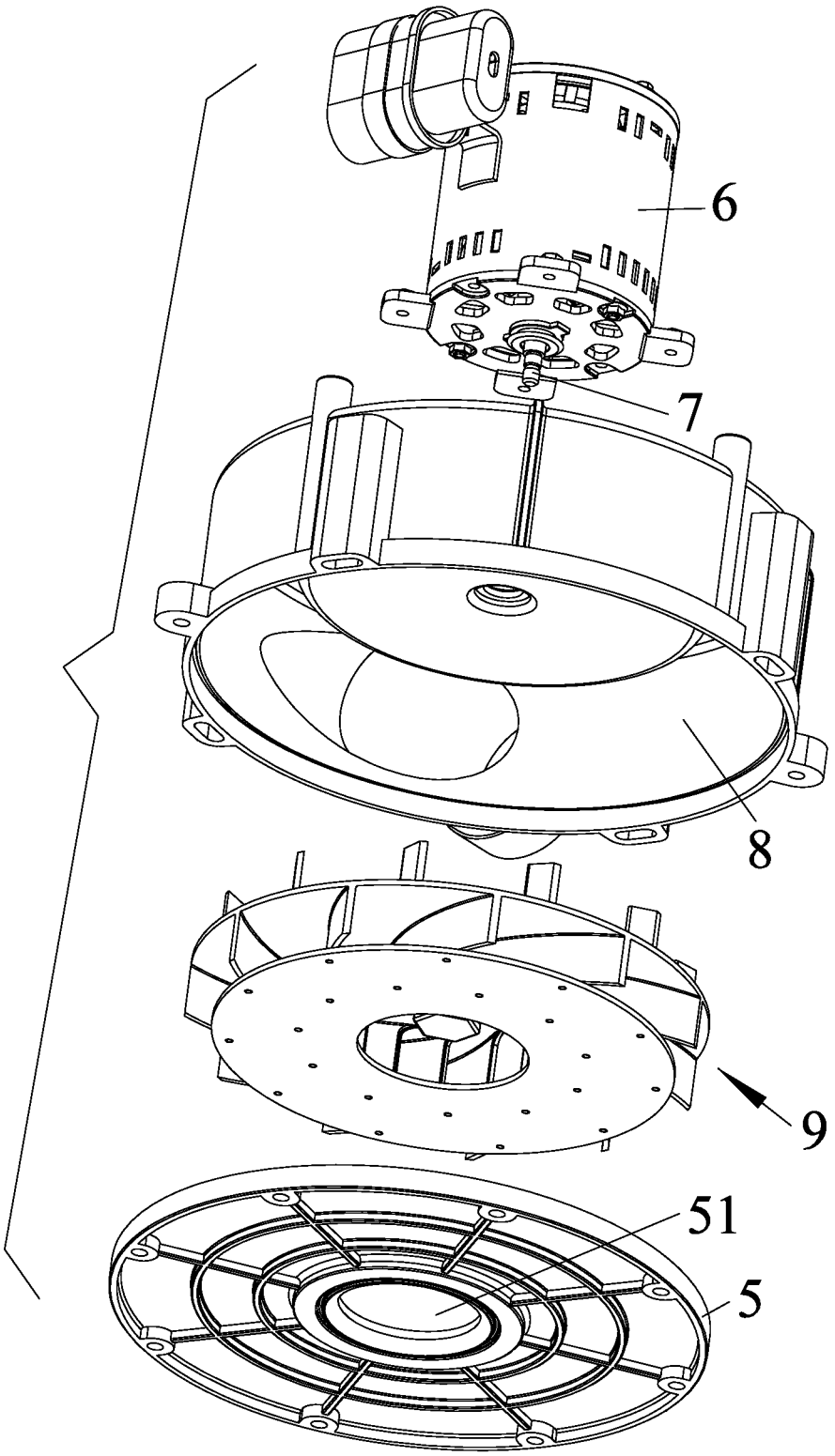
FIG. 19 is an exploded view of a blower according to one embodiment of the disclosure.
Figure 20:
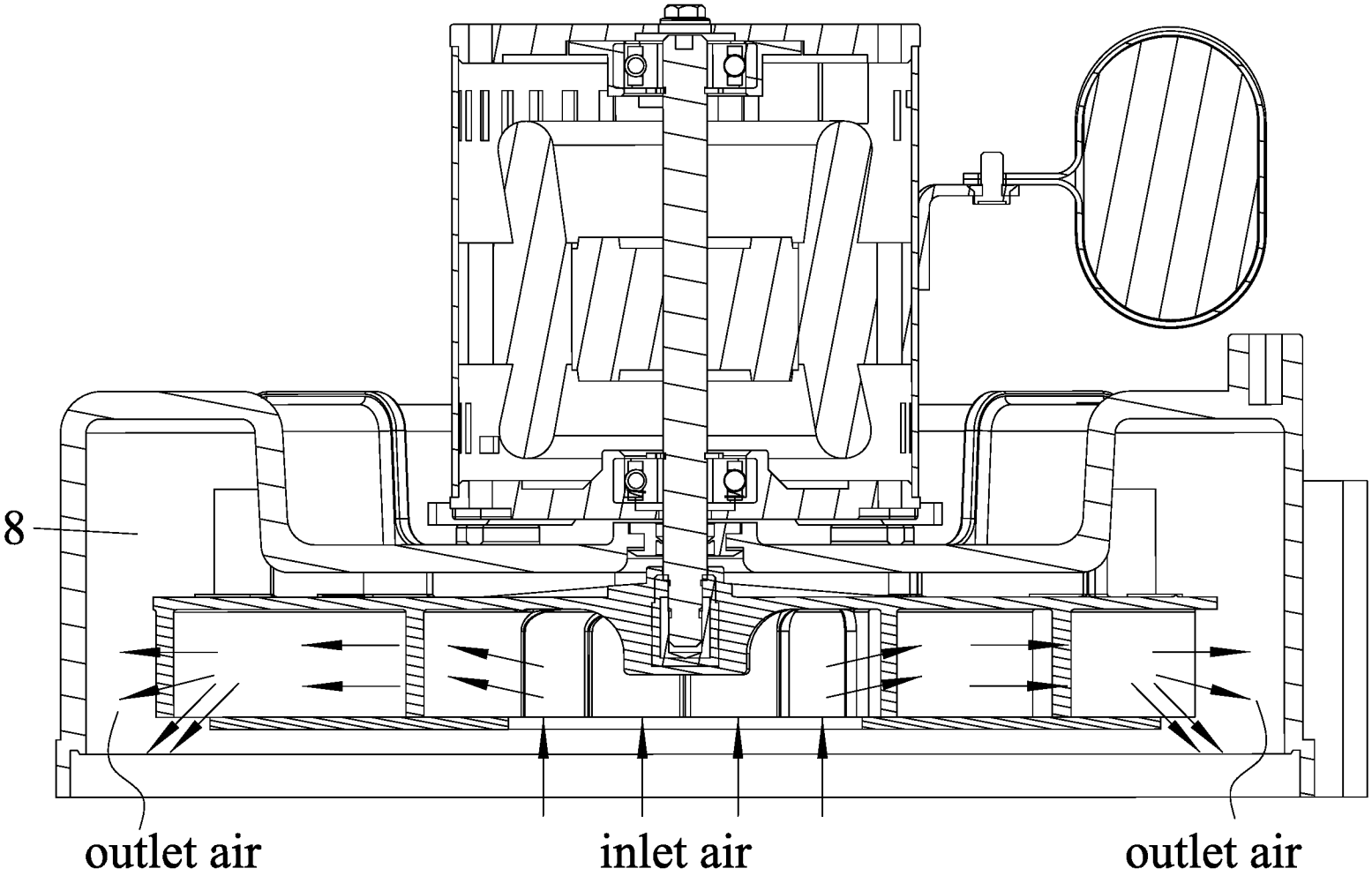
FIG. 20 shows an air flow direction of a blower according to one embodiment of the disclosure.

As shown in FIGS. 18-20, a blower comprises a volute 4, a cover plate 5, a motor 6, a motor shaft 7 and the windwheel 9 in Example 1 or 2. The volute 4 is connected to the cover plate 5 whereby forming a cavity 8; the windwheel 9 is disposed in the cavity 8; the volute 4 comprises an air outlet 41, and the cover plate 5 comprises an air intake 51.

It will be obvious to those skilled in the art that changes and modifications may be made, and therefore, the aim in the appended claims is to cover all such changes and modifications.

What is claimed is:

1. A device, comprising:

1) a first end plate;

2) a second end plate; and 3) a plurality of primary blades disposed between the first end plate and the second end plate;

wherein:

the first end plate comprises a central part provided with a base connected to a motor shaft;

the second end plate comprises a central part provided with an air inlet;

a space between every two adjacent blades forms an air channel;

the plurality of primary blades each comprises a first end face abutting against the first end plate, a second end face abutting against the second end plate, and an outmost end with respect to the central part of the first end plate; wherein the outmost end comprises an outmost face that is extended between the first end face and the second end face;

the outmost ends extend out of an outer edge of the second end plate;

the outmost faces of the plurality of primary blades define a circle of a diameter D1 along each plane that is perpendicular to the central axis of the motor shaft, and the diameter D1 of the circle is larger than a diameter D2 of the second end plate; and a ratio of the diameter D2 of the second end plate to the diameter D1 of the circle is between 0.85 and 0.95.

2. The device of claim 1, wherein the first end plate comprises an outer edge with respect to the central part; the outer edge comprises a plurality of secondary blades; and the plurality of secondary blades and the plurality of primary blades are disposed on two opposite surfaces of the first end plate, respectively.

3. The device of claim 2, wherein the diameter D1 of the circle is equal to a diameter of the first end plate.

4. The device of claim 1, wherein D2=0.9 D1.

5. The device of claim 1, wherein the second end face comprises a plurality of locating pins; the second end plate comprises a plurality of mounting holes; and the plurality of locating pins is disposed in or bonded to the plurality of mounting holes, respectively.

6. The device of claim 5, wherein the plurality of primary blades is integrated with the first end plate through injection molding; the second end face further comprises a plurality of lug bosses; the second end plate further comprises a plurality of grooves; and the plurality of lug bosses is disposed in or bonded to the plurality of grooves, respectively.

7. The device of claim 6, wherein the first end plate comprises a surface; the surface comprises an outer edge with respect to the central part; the outer edge comprises a plurality of secondary blades protruding from the surface; the plurality of secondary blades and the plurality of primary blades are disposed on two opposite surfaces of the first end plate, respectively; and both the plurality of secondary blades and the plurality of primary blades are integrated with the first end plate through injection molding.

8. The device of claim 7, wherein the second end plate further comprises a plurality of bulges disposed in each of the plurality of grooves; when the plurality of lug bosses is disposed in the plurality of grooves, the plurality of lug bosses abuts against the plurality of bulges, respectively.

9. The device of claim 8, wherein the plurality of bulges is equidistantly disposed in each of the plurality of grooves.

10. The device of claim 9, wherein the plurality of lug bosses is disposed on two ends of the second end face, respectively; and a recess is disposed between every two adjacent lug bosses.

11. The device of claim 10, wherein the plurality of locating pins on the second end face of the plurality of primary blades is disposed in the recess.

12. A blower, comprising a volute, a cover plate, a motor, a motor shaft and the device of claim 1, wherein the volute is connected to the cover plate whereby forming a cavity; the device is disposed in the cavity; the volute comprises an air outlet, and the cover plate comprises an air intake.

13. A device, comprising:

1) a first end plate;

2) a second end plate; and 3) a plurality of primary blades disposed between the first end plate and the second end plate;

wherein:

the first end plate comprises a central part provided with a base connected to a motor shaft;

the second end plate comprises a central part provided with an air inlet;

a space between every two adjacent blades forms an air channel;

the plurality of primary blades each comprises an outmost end with respect to the central part of the first end plate, and the outmost end extends out of an outer edge of the second end plate;

the outmost ends of the plurality of primary blades form a circle, and a diameter D1 of the circle is larger than a diameter D2 of the second end plate;

the plurality of primary blades each comprises an end face abutting against the second end plate; the end face comprises a plurality of locating pins; the second end plate comprises a plurality of mounting holes; and the plurality of locating pins is disposed in or bonded to the plurality of mounting holes, respectively;

the plurality of primary blades is integrated with the first end plate through injection molding; the end face further comprises a plurality of lug bosses; the second end plate further comprises a plurality of grooves; and the plurality of lug bosses is disposed in or bonded to the plurality of grooves, respectively; and the second end plate further comprises a plurality of bulges disposed in each of the plurality of grooves; when the plurality of lug bosses is disposed in the plurality of grooves, the plurality of lug bosses abuts against the plurality of bulges, respectively.

14. The device of claim 13, wherein the plurality of bulges is equidistantly disposed in each of the plurality of grooves.

15. The device of claim 14, wherein the plurality of lug bosses is disposed on two ends of the end face, respectively; and a recess is disposed between every two adjacent lug bosses.

16. The device of claim 15, wherein the plurality of locating pins on the end face of the plurality of primary blades is disposed in the recess.

17. The device of claim 16, wherein two locating pins are disposed on two ends of the recess, respectively.

18. The device of claim 13, wherein a ratio of the diameter D2 of the second end plate to the diameter D1 of the circle is between 0.85 and 0.95.

19. The device of claim 18, wherein D2=0.9 D1.

* * * * *